US011137227B2

(12) United States Patent
Barrett

(10) Patent No.: US 11,137,227 B2
(45) Date of Patent: Oct. 5, 2021

(54) ADJUSTABLE FIREARM MOUNT APPARATUS AND METHOD OF MOUNTING A FIREARM

(71) Applicant: Ronnie Barrett, Murfreesboro, TN (US)

(72) Inventor: Ronnie Barrett, Murfreesboro, TN (US)

( * ) Notice: Subject to any disclaimer, the term of this patent is extended or adjusted under 35 U.S.C. 154(b) by 0 days.

(21) Appl. No.: 16/244,477

(22) Filed: Jan. 10, 2019

(65) Prior Publication Data

US 2019/0376760 A1 Dec. 12, 2019

Related U.S. Application Data

(60) Provisional application No. 62/617,518, filed on Jan. 15, 2018.

(51) Int. Cl.
*F41A 27/00* (2006.01)
*F41A 27/06* (2006.01)

(52) U.S. Cl.
CPC ..... *F41A 27/06* (2013.01)

(58) Field of Classification Search
CPC ..... F41A 27/06; F41A 27/08; F41A 27/16; F41A 25/22
USPC ..... 42/94; 89/37.02, 37.03, 37.04, 37.14
See application file for complete search history.

(56) References Cited

U.S. PATENT DOCUMENTS

| | | | | |
|---|---|---|---|---|
| 1,303,023 | A * | 5/1919 | Buckham | F41A 27/06 89/37.03 |
| 1,671,281 | A * | 5/1928 | Gorton | F16M 11/10 89/40.06 |
| 2,376,835 | A * | 5/1945 | Trotter | F41A 9/54 89/33.14 |
| 9,310,154 | B1 * | 4/2016 | Charpie, III | F41A 23/54 |
| 9,518,795 | B1 * | 12/2016 | Dix | F41A 27/12 |
| 9,683,803 | B2 * | 6/2017 | Dix | F41A 23/12 |

FOREIGN PATENT DOCUMENTS

GB 14286 * 11/1916

* cited by examiner

*Primary Examiner* — Michael D David
(74) *Attorney, Agent, or Firm* — Patterson Intellecutal Property Law, P.C.; Ryan D. Levy

(57) ABSTRACT

An adjustable firearm mount apparatus includes a main support. The main support includes a base end and an adjustment end opposite the base end. A longitudinal axis extends along a length from the base end to the adjustment end. At least one first mounting section is configured to interface with a first portion of a firearm. At least one passageway is defined in the main support and extends in a direction parallel to the longitudinal axis. An auxiliary support is slidably connected to the main support nearer the adjustment end than the base end. The auxiliary support includes at least one elongate member received in the passageway and at least one second mounting section configured to interface with a second portion of the firearm.

8 Claims, 15 Drawing Sheets

ADJUSTABLE FIREARM MOUNT APPARATUS AND METHOD OF MOUNTING A FIREARM

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application claims benefit of the following patent application(s) which is/are hereby incorporated by reference: 62/617,518 filed Jan. 15, 2018

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present disclosure relates to firearms, specifically the M240 machine gun and variants thereof. More particularly, the disclosure pertains to an adjustable firearm mount apparatus, which may be used with the M240 machine gun and variants thereof.

The M240 machine gun has generally been used by the United States military since at least about the late 1970's. Currently, the firearm has multiple applications being used by both infantry as well as with vehicles, both on land and on water. In use, the M240 machine gun is often fired from an integrated bipod or from a mount that may be attached to a vehicle or a fixed location. While not the lightest machine gun in use, the firearm is very reliable and relatively standardized among the NATO countries.

Historically, the M240 machine gun was modeled after features of the Browning machine gun of 1919 and the Browning automatic rifle of 1918. Through this thinking, the M240 machine gun developed with a box-type receiver with the shoulder stock placed on the rear of the receiver. There are multiple variants of the M240 machine gun. One such variant is the M240LW machine gun as designed by Barrett Firearms Manufacturing. Generally, the M240LW is understood to be an M240 variant which uses a unitary first shell and a unitary second shell to create the receiver for the firearm. Such firearm is described in U.S. Pat. No. 7,937,877, issued to Christopher Gene Barrett and entitled "Light Weight Firearm and Method of Manufacturing." What is desired, therefore, is an adjustable gun mount apparatus that may be used with the multiple variants of the M240 machine gun.

BRIEF SUMMARY OF THE INVENTION

As used herein, "rear" refers to a longitudinal direction closer to the butt stock of the firearm than the muzzle of the firearm, and "forward" refers to a longitudinal direction closer to the muzzle of the firearm than the buttstock of the firearm. When "rear" or "rearward" is used herein to describe the relationship between parts, the term denotes that the part located rearward is closer to the butt stock than the other part. When "forward" is used herein to describe the relationship between parts, the term denotes that the part located forward is closer to the muzzle than the other part.

Also as used herein, M240 refers to the family of belt-fed, gas operated machine guns which generally fire the 7.62×51 mm NATO cartridge. Further as used herein, the term "M240" is generally synonymous with the Belgian FN MAG58 machine gun and is used to include variants. Variants of the M240 machine gun may include but are not limited to the M240B, M240C, M240D, M240G, M240H, M240L, M240E1 and E5, M240L, and M240LW. While discussions of various optional embodiments may describe specific variants of the M240 machine gun, the use of "M240" is intended to include all variants so long as feasible, including when also present in the claims. Also, to the extent semi-automatic versions and/or single shot variants of the M240 machine gun exist, the use of "M240" is intended to include these variants so long as feasible.

In accordance with one optional aspect, an adjustable gun mount apparatus includes a main support. The main support includes a base end and an adjustment end opposite the base end. A longitudinal axis extends along a length from the base end to the adjustment end. At least one first mounting section is configured to interface with a first portion of a firearm. At least one passageway is defined in the main support. The passageway extends in a direction parallel to the longitudinal axis. An auxiliary support is slidably connected to the main support nearer the adjustment end than the base end. The auxiliary support may include at least one elongate member received in the passageway and at least one second mounting section configured to interface with a second portion of the firearm.

In accordance with another optional aspect, the first mounting section may include two first coaxial holes configured to receive a respective first mount pin therethrough, and the second mounting section may include two second coaxial holes configured to receive a respective second mount pin there through.

In accordance with other optional aspects, a pintle may be hingedly connected to the main support nearer the base end than the adjustment end.

In accordance with yet another optional aspect, the auxiliary support may include two elongate members received in two corresponding passageways defined in the main support.

In accordance with a further optional aspect, each passageway may comprise a longitudinal bore including an opening in the adjustment end of the main support and extending toward the base end in a direction parallel to the longitudinal axis.

In accordance with still another optional aspect, each elongate member may include a transverse bore configured to receive a set pin. The main support may further include one or more pin holes defined in the main support and located such that a pin hole extends through each respective passageway in a direction perpendicular to the longitudinal axis. The main support and the auxiliary support may be configured to receive each set pin in a respective pin hole and a corresponding transverse bore, thereby maintaining the main support and the auxiliary support at a fixed distance from each other.

In accordance with another optional aspect, both the elongate members and the passageways may include circular cross-sections.

In accordance with other optional aspects, the main support may include a plurality of pin holes extending through each passageway such that the set pins may selectively maintain the main support and the auxiliary support at any one of a plurality of fixed distances from each other.

In accordance with a further optional aspect, the passageway may extend along a majority of the length of the main support.

In accordance with a still further optional aspect, an adjustable gun mount apparatus may be configured to be used with an M240 machine gun. The adjustable gun mount apparatus may include a forward support with a forward mount hole defined in the forward support and configured to align with a forward mounting point of the M240 machine gun. A forward mount pin may be configured to be received in the forward mount hole and the forward mounting point.

The adjustable gun mount may also include a rear support with a hole defined in it, and the hole configured to align with a rear mounting point of the M240 machine gun. A rear mount pin may be configured to be received in the rear mount hole and the rear mounting point. A guide system may slidably connect the forward support to the rear support such that a distance between the forward support and the rear support may be adjusted.

In accordance with yet a further optional aspect, the guide system may include a guide connected to one of the forward support and the rear support. The guide may include an elongate member. A passage may be defined in the forward support and the rear support with the passage receiving the guide therein.

In accordance with another optional aspect, the guide may be connected to the rear support, and the passage may be defined in the forward support.

In accordance with some optional aspects, the forward support includes a length, and the passage may be defined along a majority of the length.

In accordance with other optional aspects, a guide pin hole may be defined in the guide. A passage pin hole may also be defined in a passage. A pin may be configured to be inserted in the guide pin hole and the passage pin hole when the guide pin hole and the passage pin hole are in alignment.

In accordance with still other optional aspects, the guide system may further include two or more guides and two or more corresponding passages to receive the respective guides.

In accordance with further optional aspects, the guide system may be configured to maintain the forward support and the rear support at any one of a plurality of discrete distances from each other.

In accordance with yet further optional aspects, a forward clevis may include a forward mount hole, a rear clevis may include a rear mount hole, the forward mount pin may be a forward clevis pin, and the rear mount pin may be a rear clevis pin.

In accordance with still further optional aspects, a method of mounting a gun to an adjustable gun mount apparatus includes: aligning a first mounting section of a main support with a first portion of the gun, securing the first portion to the first mounting section, sliding an auxiliary support relative to the main support, aligning a second mounting section of the auxiliary support with a second portion of the gun, and securing the second portion to the second mounting section.

In accordance with another optional aspect, the method may include aligning a first hole of the first mounting section with a first mounting point of the first portion. The method may also include inserting a first mount pin in the first hole and the first mounting point. A second hole of the second mounting section may be aligned with a second mounting point of the second portion. A second mount pin may be inserted in the second hole and the second mounting point.

In accordance with another further optional aspect, the method may include securing the auxiliary support relative to the main support by inserting a set pin in both a pin hole defined in the main support and a transverse bore defined in an elongate member of the auxiliary support.

Aside from the structural and procedural arrangements set forth above, the invention could include a number of other arrangements, such as those explained hereinafter. It is to be understood, that both the foregoing description and the following description are exemplary.

The accompanying drawings are incorporated in and constitute a part of the specification. The drawings illustrate optional embodiments of the invention and together with the description serve to explain some principles of the invention.

BRIEF DESCRIPTION OF THE SEVERAL VIEWS OF THE DRAWINGS

Reference will now be made in detail to optional embodiments of the invention, examples of which are illustrated in accompanying drawings. Whenever possible, the same reference numbers are used in the drawings and in the description referring to the same or like parts.

DETAILED DESCRIPTION OF THE INVENTION

Figure 1:
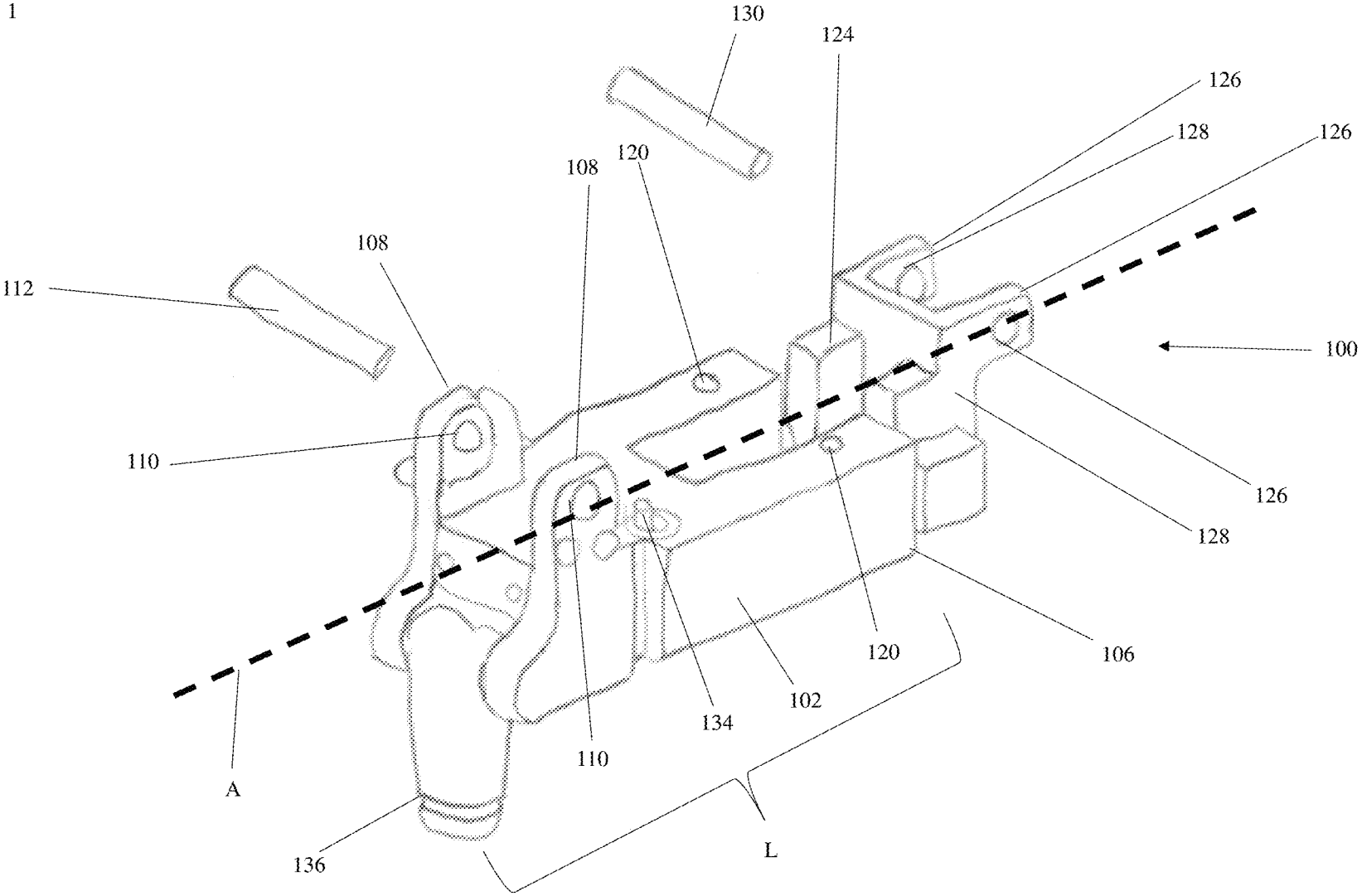
FIG. 1 is a perspective view of an embodiment of an adjustable gun mount apparatus in a retracted position with the mount pins exploded therefrom.

While the making and using of various embodiments are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

To the extent that the term "includes" or "including" is used in the specification or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." Furthermore, to the extent the term "connect" is used in the specification or claims, it is intended to mean not only "directly connected to," but also "indirectly connected to" such as connected through another component or multiple components.

To facilitate the understanding of the embodiments described herein, a number of terms are defined below. The terms defined herein have meanings as commonly understood by a person of ordinary skill in the areas relevant to the embodiments described herein. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

Referring to FIGS. 1-8, an embodiment of an adjustable firearm mount apparatus 100 is shown. A firearm, particularly a M240 machine gun, 200 (as shown in FIGS. 9-12) may be mounted to the adjustable gun mount apparatus 100. The firearm 200 may include a first portion 202 and a second portion 204. The first portion 202 may include a first mounting point (or forward mounting point) 206, and the second portion 204 may include a second mounting point (or rear mounting point) 208. In some embodiments, the firearm 200 may be an M240 machine gun having a muzzle 210 and a butt stock 212. Some variations of the firearm 200 may include a shorter distance between the first mounting point 206 and the second mounting point 208 than other variations of the firearm. The firearm 200 in FIG. 9 may include a first distance D1 between the first mounting point 206 and the second mounting point 208, while the firearm in FIG. 11 may include a second distance D2 between the mounting points that is longer than the first distance. As previously discussed, the use of "M240 machine gun" includes variants and as such, different M240 machine guns may have different distances between respective mounting points 206 and 208.

Additionally, the adjustable gun mount apparatus 100 may include a main (or forward) support 102. The main support 102 may include a base end 104 and an adjustment end 106 opposite the base end. A longitudinal axis A extends along a length L from the base end 104 to the adjustment end 106. At least one first mounting section 108 of the main support 102 may be configured to interface with the first portion 202 of the firearm 200. Optionally included in the first mounting section 108 are two first coaxial holes (or first holes) 110 configured to receive a respective first (or forward) mount pin 112 therethrough. Such a configuration may form a forward clevis with the two first coaxial holes 110, and the first mount pin 112 may be referred to as a forward clevis pin. As used herein, "hole" can include a circular shaped opening, but is not required too and thus may include opening of other shapes or designs.

Stated another way, a forward mount hole 110 may be defined in the main support 102 and may be configured to align with the forward mounting point 202 of the firearm 200. The forward mount pin 112 may be configured to be received in both the forward mount hole 110 and the forward mounting point 202.

Figure 6:
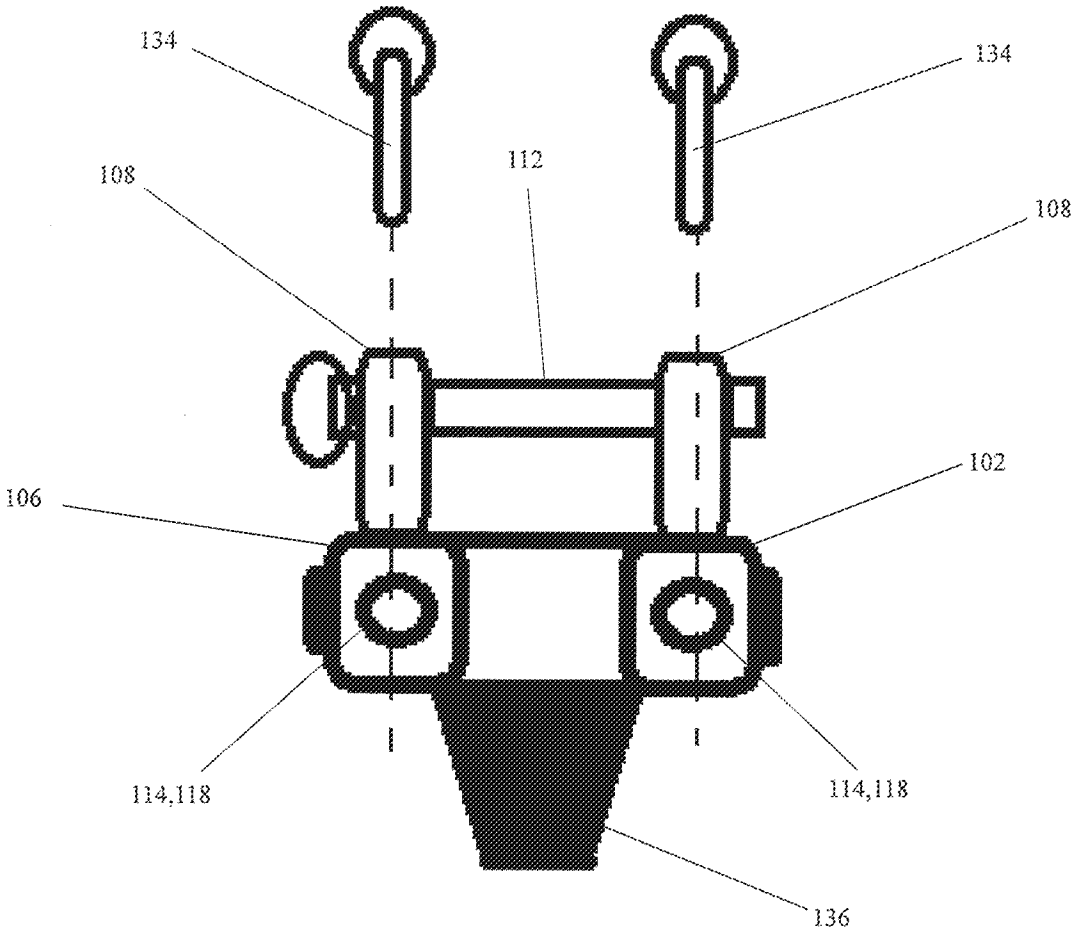
FIG. 6 is a view of the main support at line 6-6 in FIG. 5.
Figure 7:
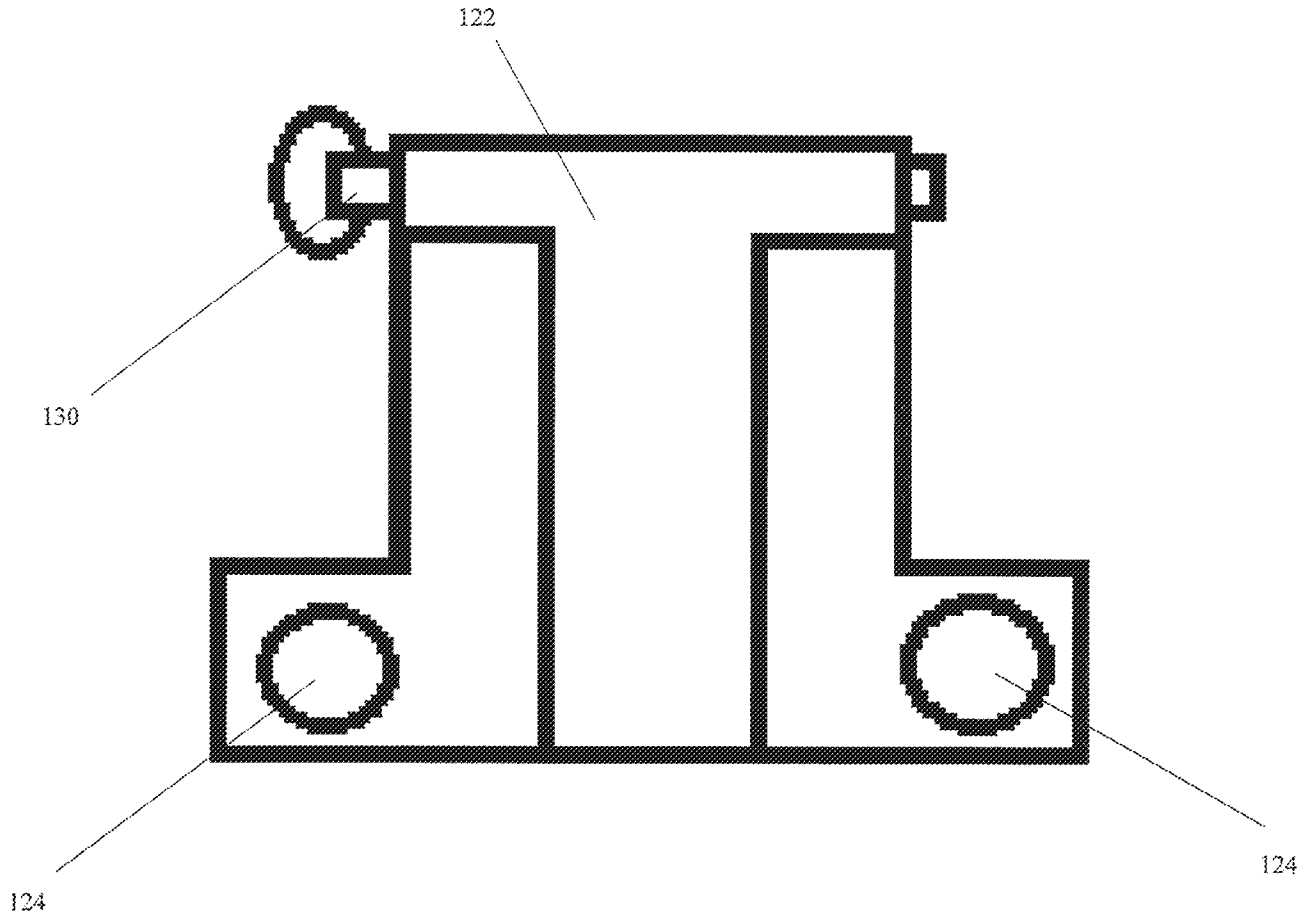
FIG. 7 is a view of the auxiliary support at line 7-7 in FIG. 5.
Figure 8:
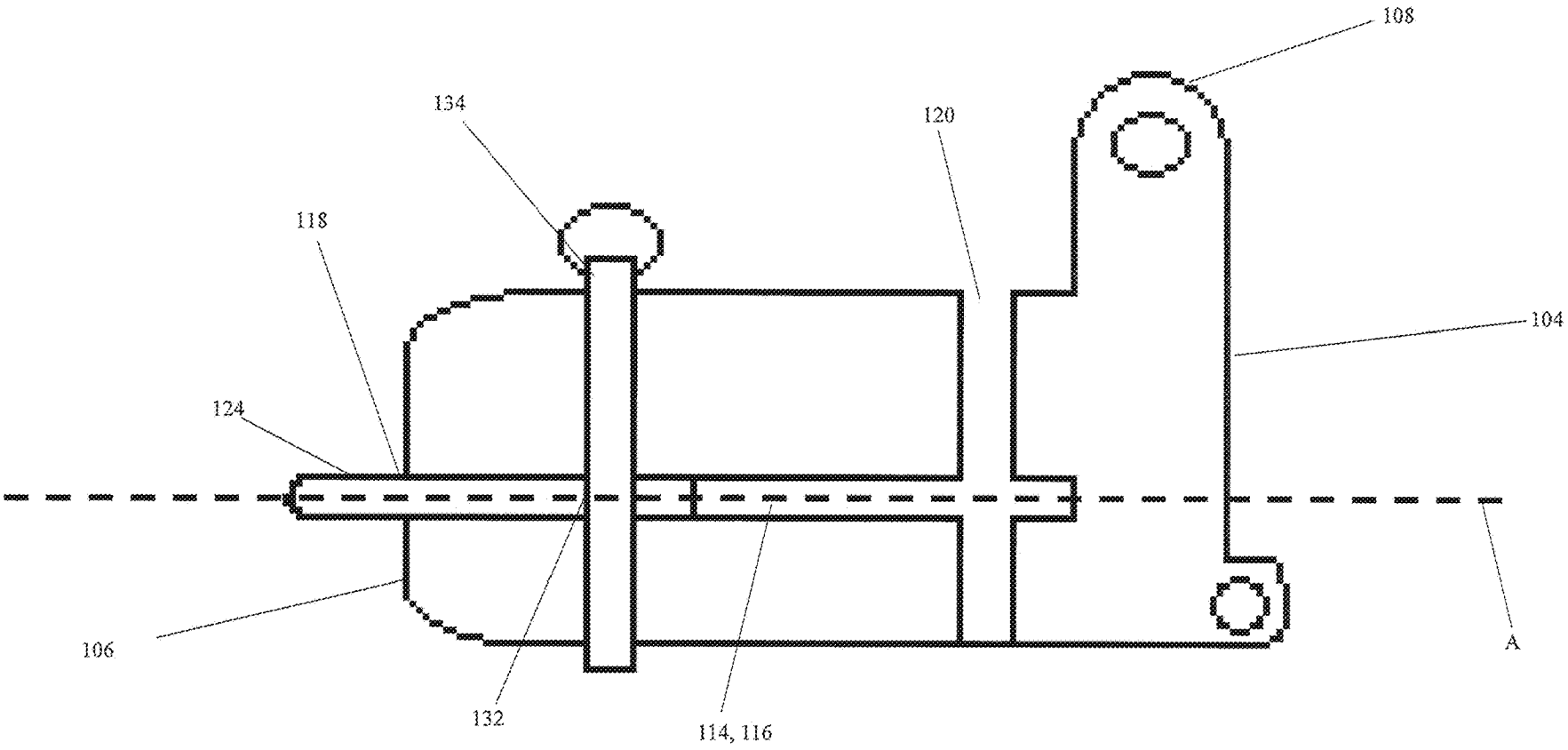
FIG. 8 is a partial cross-sectional side elevation view of the adjustable gun mount apparatus of FIG. 1 at line 8-8 in FIG. 4.
Figure 9:
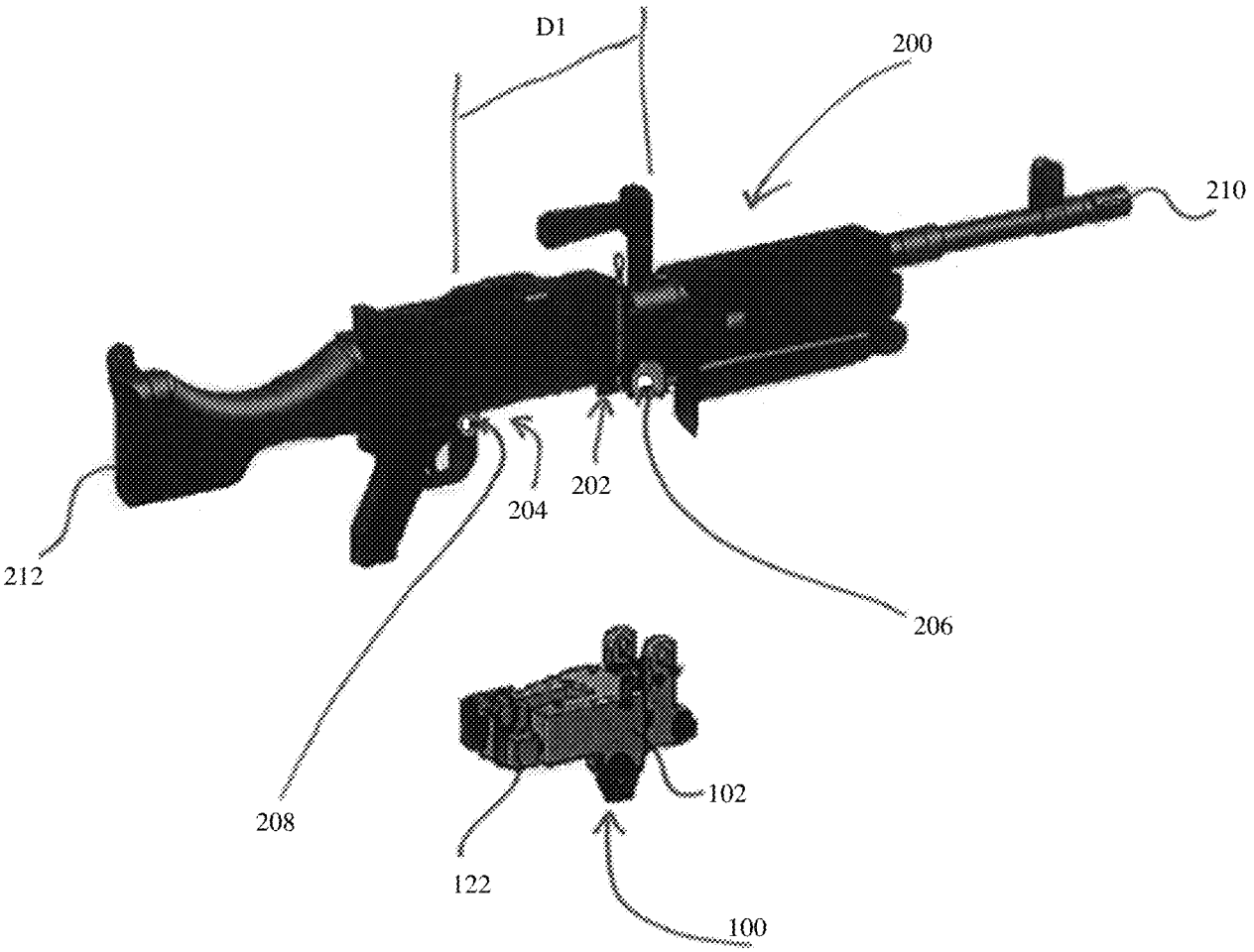
FIG. 9 is a perspective view of the adjustable gun mount apparatus of FIG. 1 with a first variant of an M240 machine gun exploded therefrom.
Figure 10:
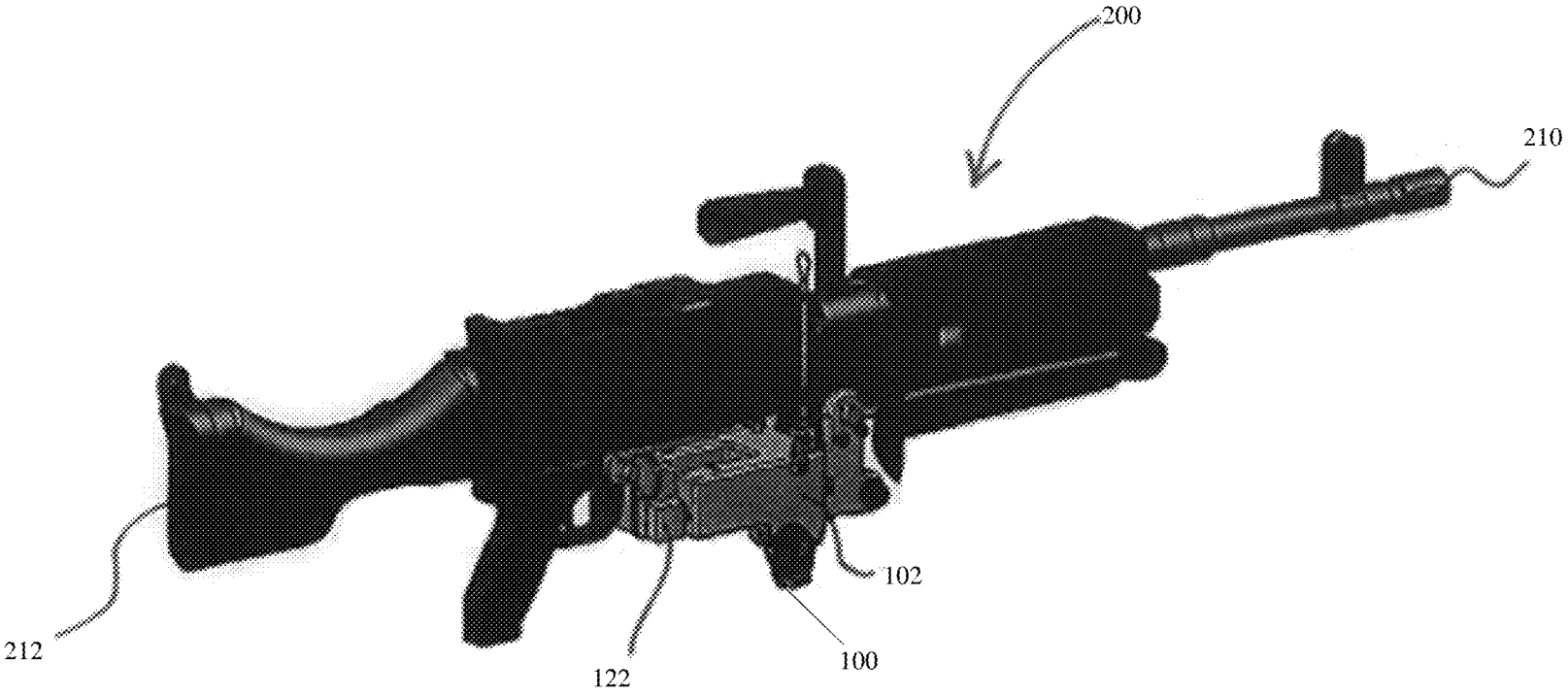
FIG. 10 is a perspective view of the adjustable gun mount apparatus of FIG. 1 with the first variant of an M240 machine gun mounted thereto.
Figure 11:
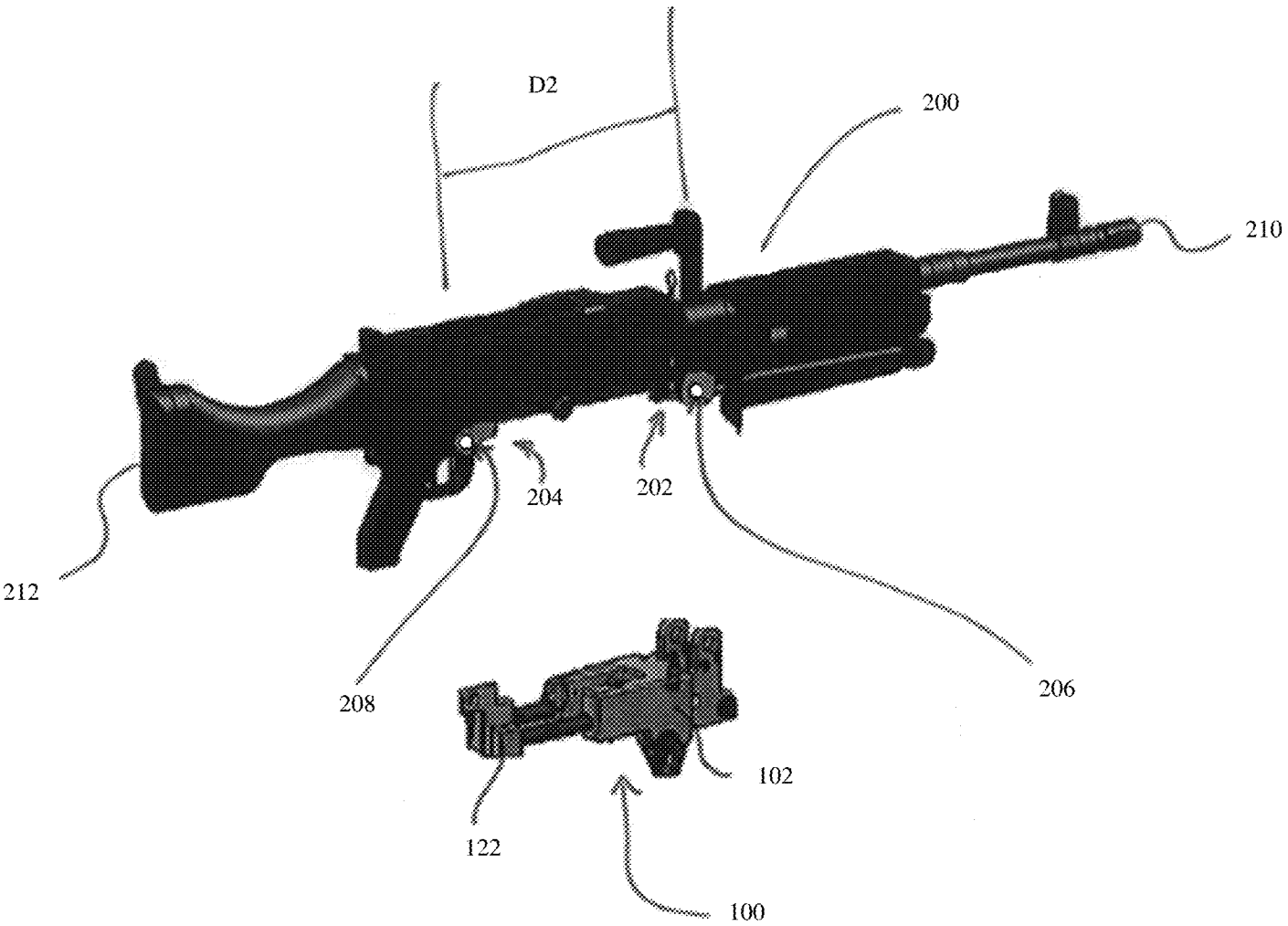
FIG. 11 is a perspective view of the adjustable gun mount apparatus of FIG. 1 with a second variant M240 type machine gun exploded therefrom.
Figure 12:
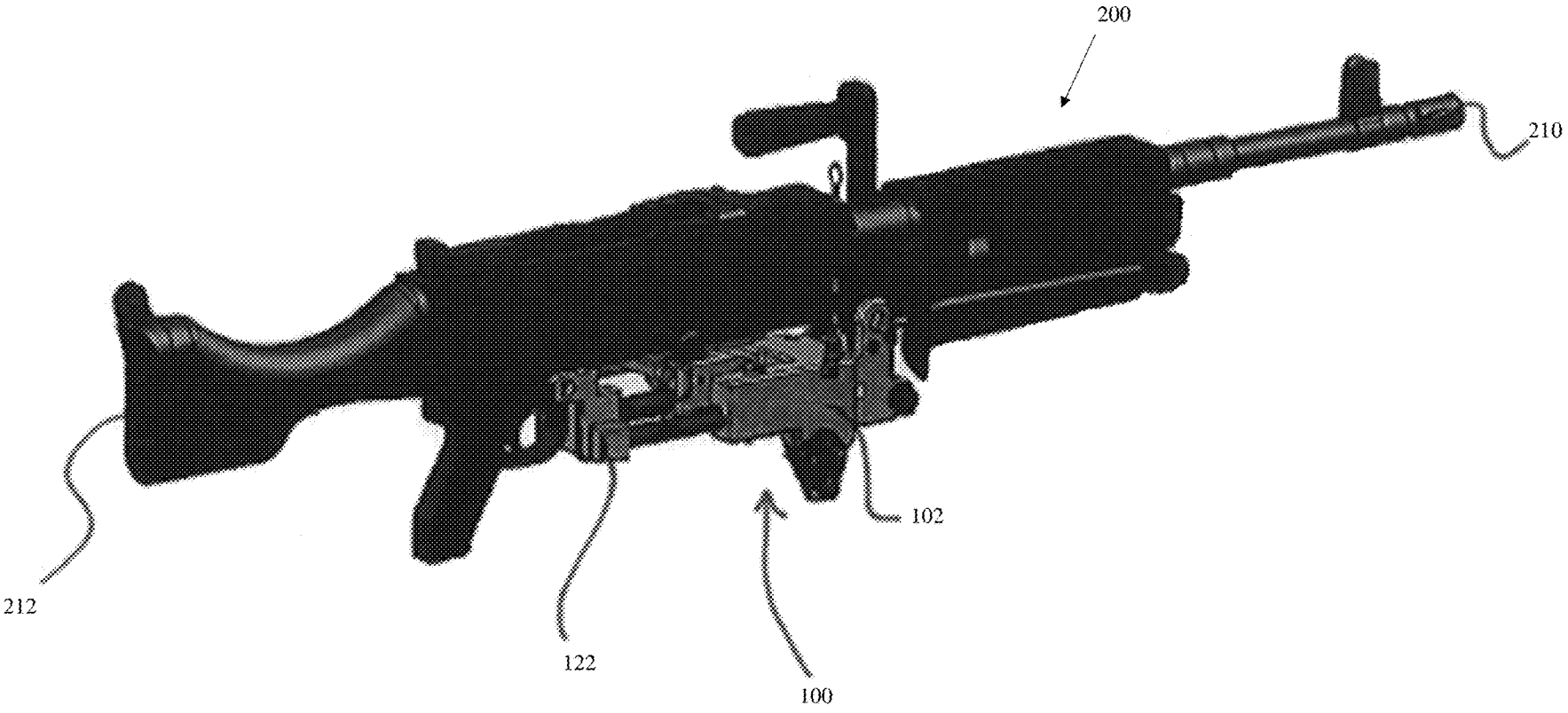
FIG. 12 is a perspective view of the adjustable gun mount apparatus of FIG. 1 with the second variant of an M240 type machine gun mounted thereto.
Figure 13:
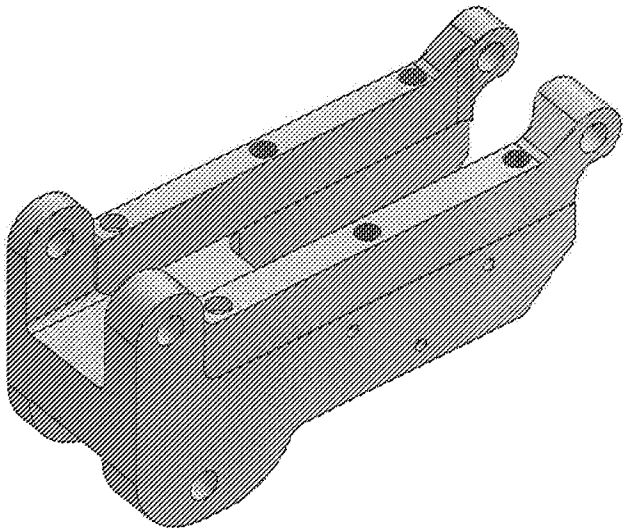
FIG. 13 is a perspective view of an additional embodiment of an adjustable gun mount apparatus.
Figure 14:
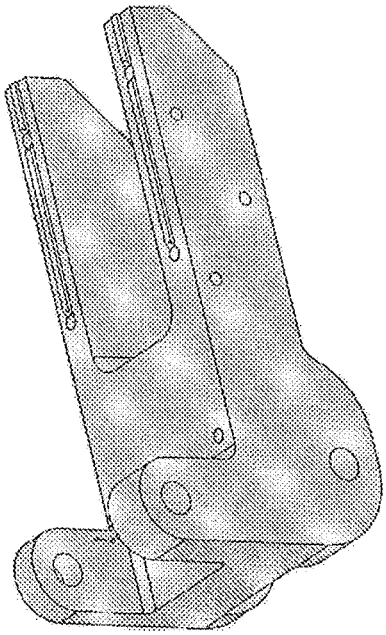
FIG. 14 is a perspective view of a top portion of the additional embodiment of an adjustable gun mount apparatus.
Figure 15:
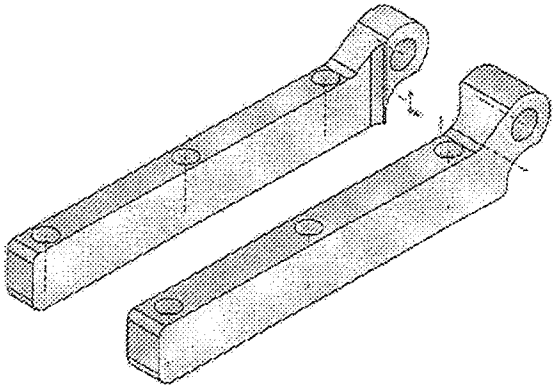
FIG. 15 is a perspective view of a bottom portion of the additional embodiment of an adjustable gun mount apparatus.

Turning now to FIGS. 6 and 8, one or more passageways (or passages) 114 may be defined in the main support 102. FIG. 8 is a cross-sectional view of main support 102 though one of the passages 114 with features of main support 102 removed so as to illustrate the interaction of elongate member 124 within passage 114 as described below. Closed bores or open channels may be included as part of a structure wholly or partially forming the passageways 114 that may be attached to the main support 102 or cut into the main support itself. The passageways 114 may extend in a direction parallel to the longitudinal axis A. In one particular embodiment, each passageway 114 may include a longitudinal bore 116 including an opening 118 in the adjustment end 106 of the main support 102 and extending toward the base end 104 in a direction parallel to the longitudinal axis A. Some embodiments may include the passageway 114 extending along a majority of the length L of the main support 102. One or more pin holes (or passage pin holes) 120 may further be defined in the main support 102 and located such that a pin hole extends through each respective passageway 114 in a direction perpendicular to the longitudinal axis A. In some embodiments, a plurality of pin holes 120 extend through each individual passageway 114. In other embodiments, the passageways may not be perpendicular to the longitudinal axis A.

Figure 2:
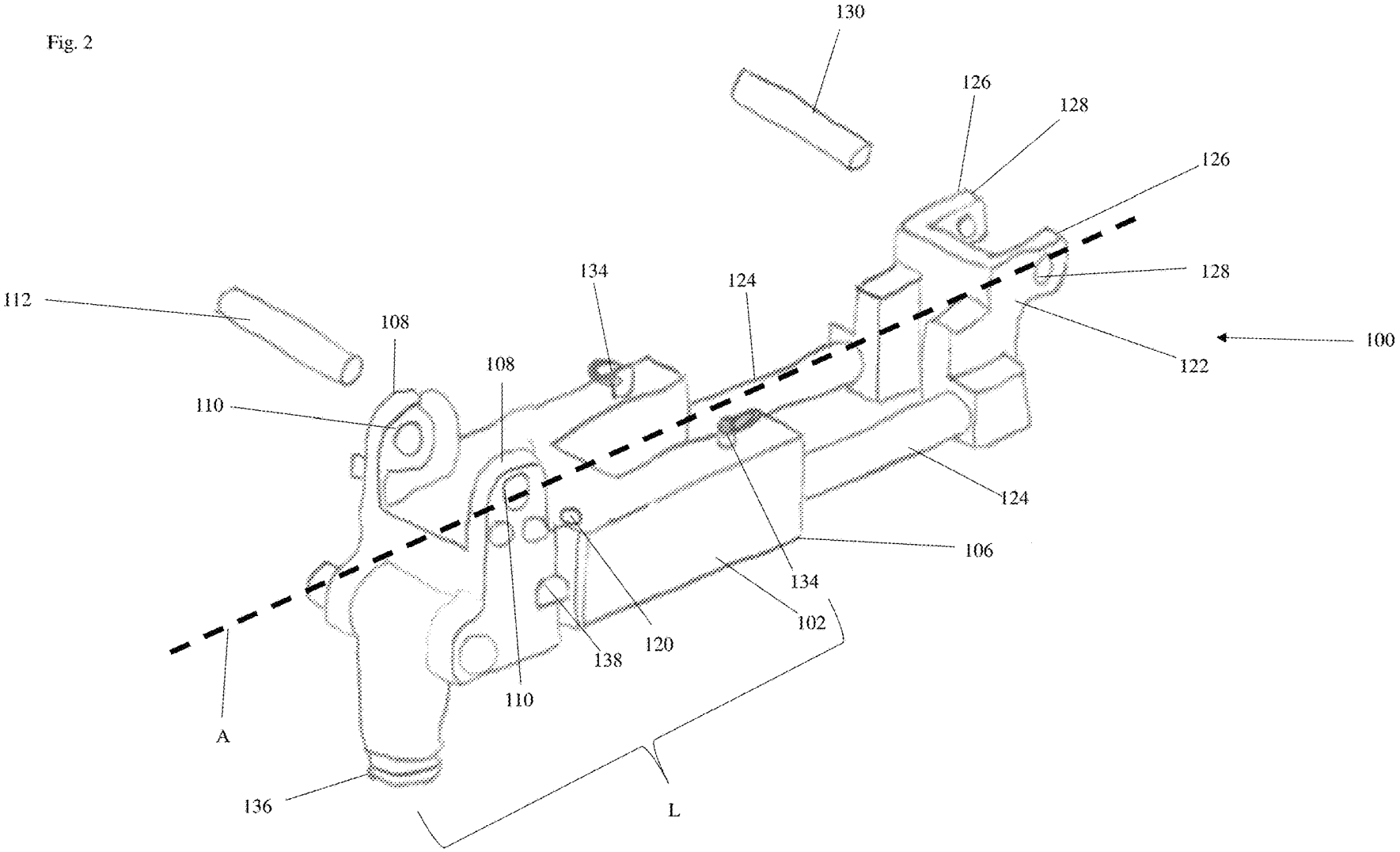
FIG. 2 is a perspective view of the adjustable gun mount apparatus of FIG. 1 in an extended position with the mount pins exploded therefrom.
Figure 3:
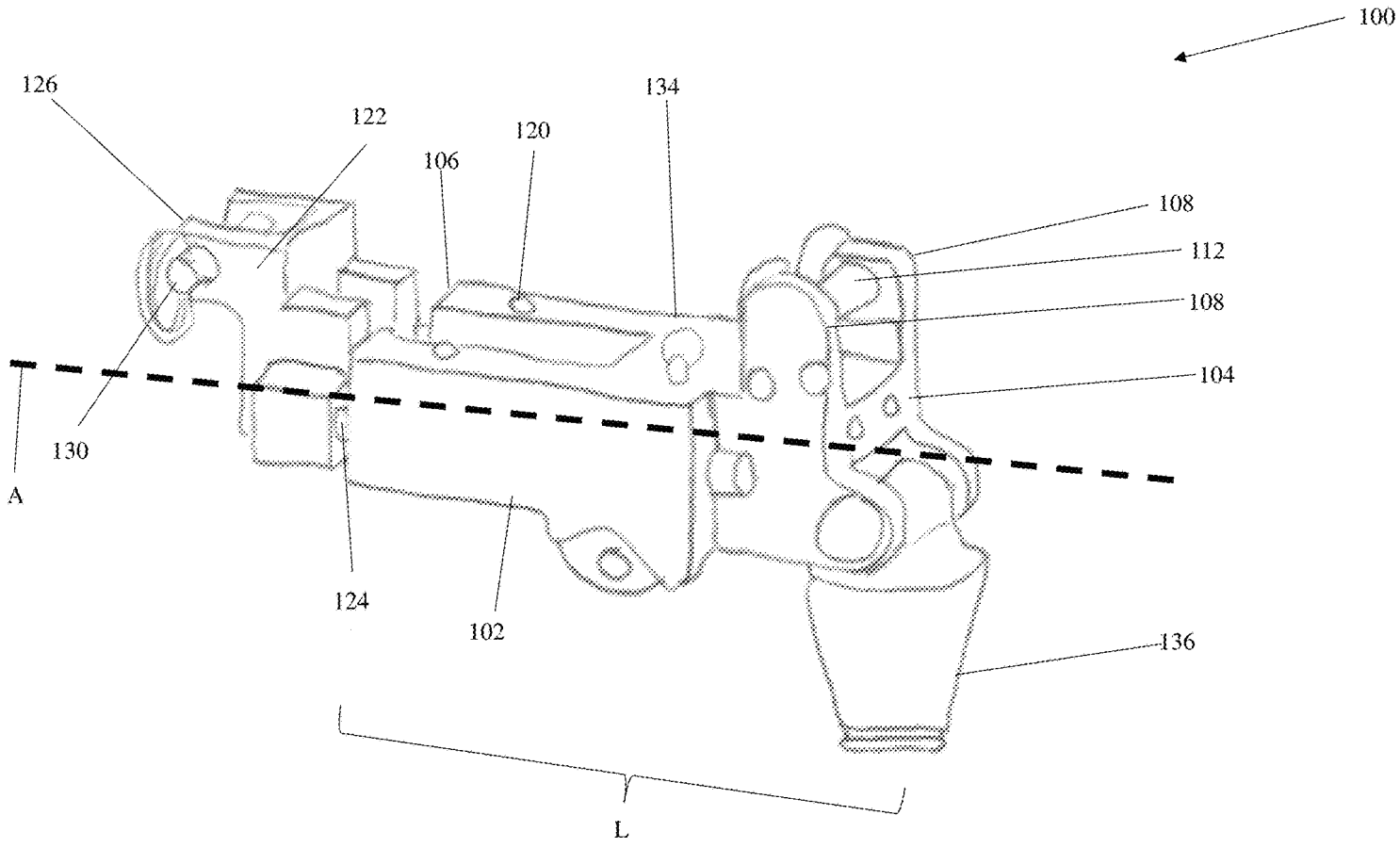
FIG. 3 is a second side view of the adjustable gun mount apparatus of FIG. 1 in the retracted position.
Figure 4:
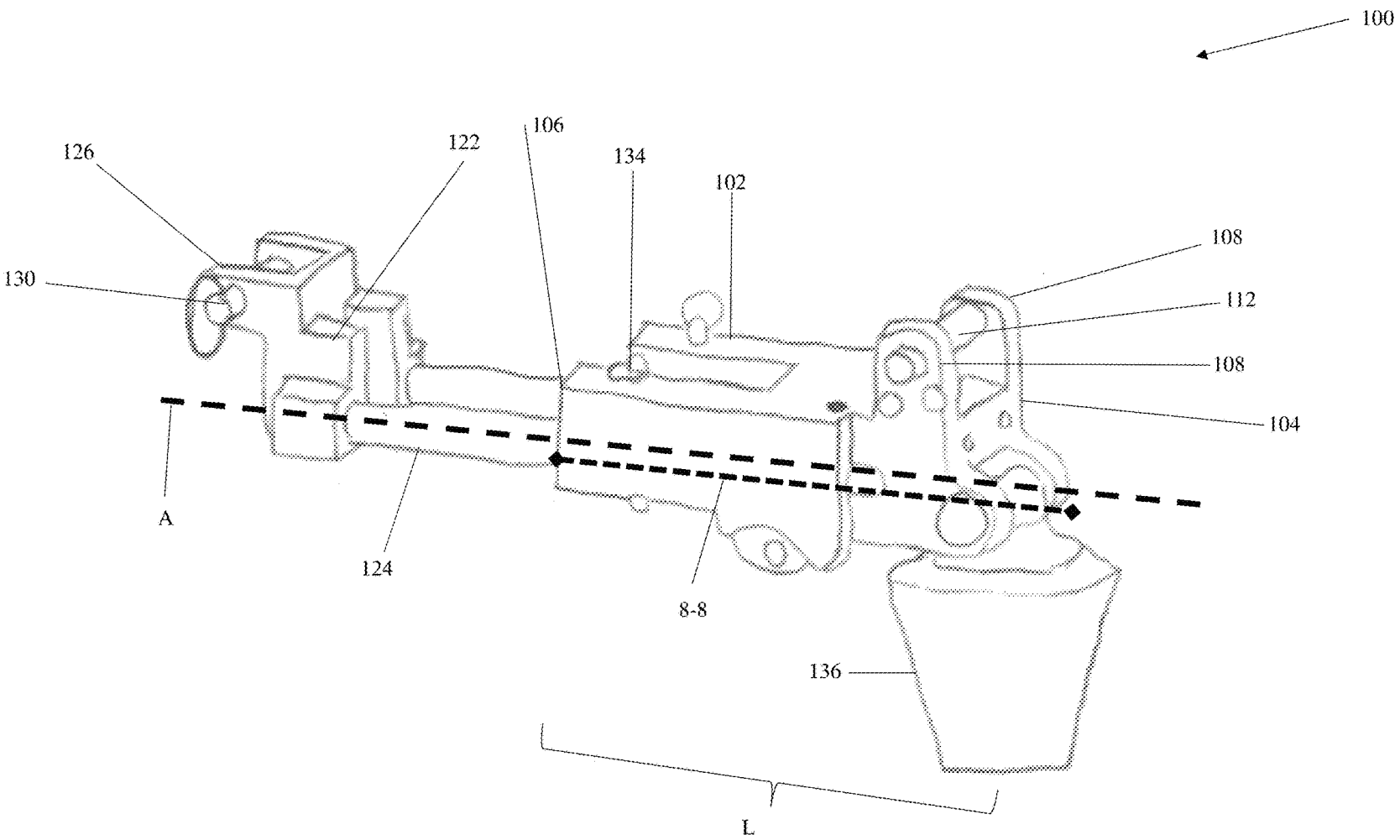
FIG. 4 is a second side view of the adjustable gun mount apparatus of FIG. 1 in the extended position.

Returning to FIG. 1, an auxiliary support (or rear support) 122 may be slidably connected to the main support 102 nearer the adjustment end 106 than the base end 104. The auxiliary support 122 may include at least one elongate member 124 received in the passageway 114. At least one second mounting section 126 of the auxiliary support 122 may be configured to interface with a second portion 204 of the firearm 200. Two second coaxial holes (or second holes) 128 may be defined in the second mounting section 126 and may be configured to receive a respective second mount pin 130 therethrough. As shown in FIGS. 1 and 2, such a configuration may form a rear clevis with the two second coaxial holes (or alternatively termed "rear mount holes") 128, and the second mount pin 130 may be a rear clevis pin. In optional embodiments, first mount pin 112 and second mount pin 130 may be interchangeable.

A rear mount hole 128 may be defined in the auxiliary support 122 and may be configured to align with the rear mounting point 204 of the gun 200. The rear mount pin 130 may be configured to be received in both the rear mount hole 128 and the rear mounting point 204.

Figure 5:
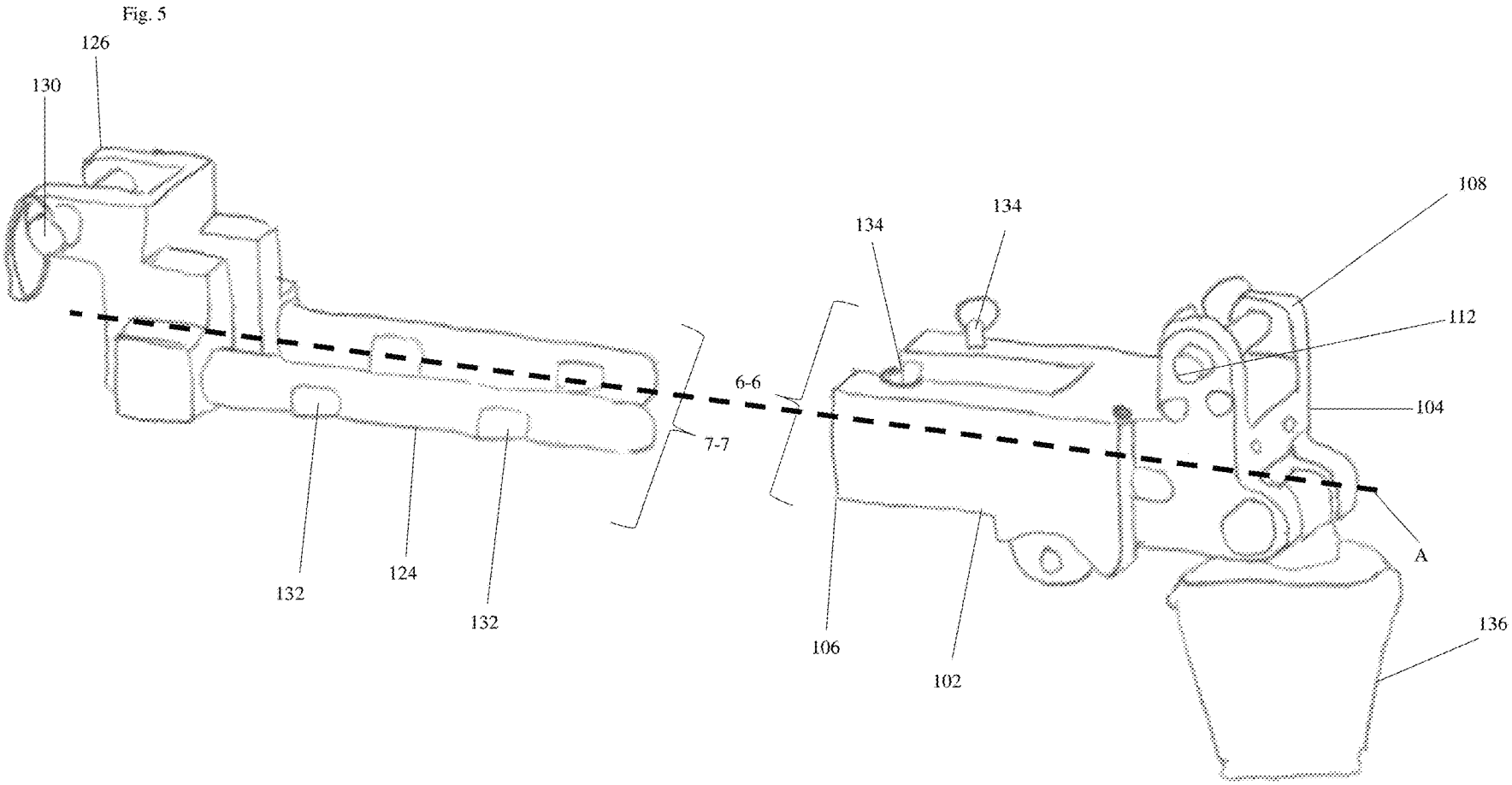
FIG. 5 is a first side view of the adjustable gun mount apparatus of FIG. 1 with the auxiliary support and the set pin exploded from the main support.

Some embodiments may include two elongate members 124 of the auxiliary support 122 with the elongate members 124 received in the corresponding passageways 114 of the main support 102. As shown in FIGS. 5 and 8, one or more transverse bores (or guide pin holes) 132 may be defined in each elongate member 124. The main support 102 and the auxiliary support 122 may be configured such that at least one pin hole 120 may align with a corresponding transverse bore 132. A pin (or set pin) 134 may then be received in the aligned pin hole 120 and transverse bore 132, thereby maintaining the main support 102 and the auxiliary support 122 at a fixed distance from each other. In one embodiment, the set pins 134 may selectively maintain the main support 102 and the auxiliary support 122 at any one of a plurality of fixed distances from each other. Two potential distances are shown in FIGS. 1 and 2, respectively. The elongate members 124 and corresponding passageways 114 may include any appropriate cross-section including, but not limited to, circular, rectangular, square, ellipsoid, and the like.

The elongate members 124 and the passageways 114 are but one example of a guide system slidably connecting the main support 102 to the auxiliary support 122. The slidable connection between the main support 102 and the auxiliary support 122 may alternatively or additionally include rails, grooves, sleeves, channels, tracks, and the like receiving one or more posts, wheels, pegs, bearings, members, fasteners, complimentary sleeves, detents, notches, and the like. This connection may be arranged such that a distance between the main support 102 and the auxiliary support 122 may be adjusted. The guide system may be configured to maintain the main support 102 and the auxiliary support 122 at any one of a plurality of discrete distances from each other. One exemplary embodiment of the adjustable gun mount apparatus 100 may include one or more detent mechanisms (not shown). The detent mechanisms may include push buttons to release the fixed relationship of the main support 102 and the auxiliary support 122 such that the main support and auxiliary support may then freely slidably adjust relative to each other. In optional embodiments, the transverse bore may take on a variety of different forms. As illustrated in the included drawings, the transverse bores 132 are generally indentations or about semi-circular voids or notches on the side of elongate members 124. In other optional embodiments, the transverse bores may be holes within elongated members 124 with pin 134 surrounded by the transverse bore. Generally, the transverse bore of an elongate member is designed so as to allow for the auxiliary support to be joined with the main support in a set spatial relationship. By selecting which transverse bore to engage on the elongate member or members, different spatial relationships can be achieved. In further optional embodiments, auxiliary support 122 includes multiple elongate members 124. In other optional embodiments, elongate member 124 includes one or more transverse bores 132.

It is not intended that the current disclosure be limited to only one configuration. The guide of the guide system may include the elongate member 124 attached to one of the main support 102 and the rear support 122 in one embodiment. The passage 114 may then be defined in another of the main support 102 and the rear support 122. The configuration shown in the Figures is but one possible arrangement of the components discussed herein.

Various other features may be attached to or defined in the adjustable gun mount apparatus 100. For instance, the adjustable gun mount apparatus may include a pintle 136 attached thereto. In one embodiment, the pintle 136 is hingedly connected to the main support 102 nearer the base end 104 than the adjustment end 106. Pivotal movement of the gun 200 may, therefore, be allowed around one or more axes while the gun is mounted to a structure (not shown) via the adjustable gun mount apparatus 100. Another possible feature is the inclusion of one or more springs (not shown) along the elongate member 124 or the passageway 114. Properly placed, a spring could bias the main support 102 and the auxiliary support 122 toward either a completely retracted position (as shown in FIG. 1) or a completely extended position (as shown in FIG. 2). FIG. 2 further illustrates one or more openings 138 defined in the main support 102 that may perform a variety of functions. Examples of such functions may include allowing air to escape the passageway 114 as the respective elongate member 124 is inserted therein, allowing user access to a part of the elongate member such that the user may push or rap the end (or some other portion) of the elongate member to free it from the respective passageway, and the like. Furthermore, opening 138 could be used with embodiments of adjustable firearm mount apparatus 100 with longer elongate members 124 which extend through such openings, thus permitting the user with a wider variety of options in orienting the main support 102 relative to the auxiliary support 122.

The present disclosure also relates to a method of mounting a firearm 200 to an adjustable firearm mount apparatus 100. The method may include: aligning a first mounting section 108 of a main support 102 with a first portion 202 of the firearm 200, securing the first portion to the first mounting section, sliding an auxiliary support 122 relative to the main support, aligning a second mounting section 126 of the auxiliary support with a second portion 204 of the gun, and securing the second portion to the second mounting section. The step of aligning the first mounting section 108 of the main support 102 with the first portion 202 of the firearm 200 may further include aligning a first hole 110 of the first mounting section with a first mounting point 206 of the first portion 202. The first portion 202 may be secured to the first mounting section 108 by inserting a first mount pin 112 in the first hole 110 and the first mounting point 206. The step of aligning the second mounting section 126 of the auxiliary support 122 with a second portion 204 of the firearm 200 may include aligning a second hole 128 of the second mounting section with a second mounting point 208 of the second portion. A second mount pin 130 may be inserted in the second hole 128 and the second mounting point 208. The method may further include securing the auxiliary support 122 relative to the main support 102 by inserting a set pin 134 in both a pin hole 120 defined in the main support and a transverse bore 132 defined in an elongate member 124 of the auxiliary support.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention of a new and useful ADJUSTABLE FIREARM MOUNT APPARATUS AND METHOD OF MOUNTING A FIREARM, it is not intended that such references be construed as limitations upon the scope of this invention except as set forth in the following claims.

What is claimed is:

1. An adjustable firearm mount apparatus for an M240 machine gun, the adjustable firearm mount apparatus comprising:

a forward support (102) including:

a forward mount hole defined in the forward support and configured to align with a forward mounting point of the M240 machine gun;

a forward mount pin configured to be received in the forward mount hole and the forward mounting point; and at least one passage defined in the forward support;

a rear support including:

a rear mount hole defined in the rear support and configured to align with a rear mounting point of the M240 machine gun; and a rear mount pin configured to be received in the rear mount hole and the rear mounting point; and a guide system slidably connecting the forward support to the rear support such that a distance between the forward support and the rear support may be adjusted, the guide system including at least one elongated member, the elongated member including at least one transverse bore; the at least one elongated member received in the at least one passage of the forward support.

2. The adjustable firearm mount apparatus for an M240 machine gun of claim 1, wherein the guide system further includes:

two elongated members received in two passageways of the forward support.

3. The adjustable firearm mount apparatus for an M240 machine gun of claim 2, wherein:

the two elongated members have a circular cross-section.

4. The adjustable firearm mount apparatus for an M240 machine gun of claim 1, further comprising:

at least one set pin in communication with a pin hold in the forward support and one of the at least one transverse bores of the at least one elongated member.

5. The adjustable firearm mount apparatus for an M240 machine gun of claim 4, further comprising:

a plurality of transverse bores in the at least one elongated member; and the at least one set pin optionally in communication with different transverse bores of the plurality of transverse bores.

6. The adjustable firearm mount apparatus for an M240 machine gun of claim 4, further comprising: a transverse bore of the at least one elongated member corresponding to a discrete distance between the forward support and the rear support.

7. The adjustable firearm mount apparatus for an M240 machine gun of claim 5, further comprising: the plurality of transverse bores in the at least one elongated member corresponding to a plurality of discrete distances between the forward support and the rear support.

8. The adjustable firearm mount apparatus for an M240 machine gun of claim 2, further comprising: two elongated members received in two passageways of the forward support, each elongated member have a plurality of transverse bores.

* * * * *